US008388380B1

(12) United States Patent
Van der Steen

(10) Patent No.: US 8,388,380 B1
(45) Date of Patent: Mar. 5, 2013

(54) WATERPROOF CONNECTOR WITH BOARD-MOUNTED SOLDERING PLATE FOR IMPROVED SEALING

(75) Inventor: Hendrikus P. G. Van der Steen, Den Dungen (NL)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/278,079

(22) Filed: Oct. 20, 2011

(51) Int. Cl.
*H01R 13/648* (2006.01)

(52) U.S. Cl. ..... 439/607.36

(58) Field of Classification Search ..... 439/607.36, 439/607.35, 607.37, 607.4, 607.01, 660
See application file for complete search history.

(56) References Cited

U.S. PATENT DOCUMENTS 5,928,035 A * 7/1999 Jankowsky et al. ..... 439/607.36
6,126,481 A * 10/2000 Wu et al. ..... 439/541.5
7,837,506 B1 11/2010 Chiang et al.
7,922,535 B1 4/2011 Jiang et al.

FOREIGN PATENT DOCUMENTS

TW 383228 M 6/2010

* cited by examiner

*Primary Examiner* — Edwin A. Leon
*Assistant Examiner* — Harshad Patel
(74) *Attorney, Agent, or Firm* — Wei Te Chung; Ming Chieh Chang

(57) ABSTRACT

A waterproof connector for mounting to a circuit board includes an insulative housing, a number of contacts fixed in the insulative housing, a metallic shell enclosing the insulative housing and a soldering plate fixed to a peripheral wall of the metallic shell. The insulative housing includes a tongue portion residing in a receiving space which is jointly formed by the insulative housing and the metallic shell. The peripheral wall defines a pair of latch holes in communication with the receiving space for locking with an inserted plug connector. The soldering plate is fixed to the peripheral wall so as to seal the pair of latch holes. The soldering plate is located between the peripheral wall and the circuit board. The soldering plate includes at least one emboss for surface mounting onto the circuit board.

20 Claims, 20 Drawing Sheets

WATERPROOF CONNECTOR WITH BOARD-MOUNTED SOLDERING PLATE FOR IMPROVED SEALING

BACKGROUND OF THE INVENTION

1. Field of the Invention

The present invention relates to a waterproof connector, and more particularly to a waterproof connector with a bottom soldering plate for mounting to a circuit board.

2. Description of Related Art

As an extra feature of the electronic devices such as mobile phones, external connectors thereof are needed to be dust and splash proof A conventional connector includes an insulative housing, a plurality of contacts fixed in the insulative housing, and a metallic shell enclosing the insulative housing. A plug receiving space is normally formed by the insulative housing and the metallic shell with the contacts exposed thereto. For locking purpose, a peripheral wall of the metallic shell defines at least one latching hole for engaging with a deformable latch of a plug connector when it is inserted into the plug receiving space. If such latching hole is not sealed, water may easily enter into the inner side of the electronic devices through the latching holes and damage the printed circuit board, ultimately.

In order to solve this problem, a kind of waterproof connector includes an insulative housing with a plurality of contacts embedded therein, a metallic shell enclosing the insulative housing, and an outer insulative sleeve further enclosing the metallic shell via overmolding technology. Obviously, such outer sleeve may enlarge the whole connector dimensions. of waterproof connector including an insulative housing, a plurality of contacts mounted on the insulative housing, an inner metal shell enclosing the insulative housing, and an outer metal shell covering the inner metal shell. The inner metal shell defines a receiving cavity at the front side thereof for the insulative housing to reside therein. An upper wall of the inner metal shell defines a pair of latching holes for locking with a plug connector. The outer shell includes a top wall defining a pair of recesses for sealing the latching holes. Besides, the outer shell is provided with a pair of side legs bending downwardly from lateral edges of the top wall for mounting to a circuit board. Such side legs extend vertically through the inner metal shell when they are mounted to the circuit board, which will complicate the mounting process and the structure of the outer metal shell.

Hence, a waterproof connector having an improved waterproof soldering plate is desired.

BRIEF SUMMARY OF THE INVENTION

The present invention provides a waterproof connector for mounting to a circuit board. The waterproof connector includes an insulative housing, a plurality of contacts fixed in the insulative housing, a metallic shell enclosing the insulative housing and a soldering plate fixed to the metallic shell. The insulative housing includes a tongue portion residing in a receiving space which is jointly formed by the insulative housing and the metallic shell. Each contact includes a contacting portion exposed on the tongue portion. The metallic shell includes a peripheral wall defining an end gap and a pair of latch holes in communication with the receiving space. The pair of latch holes are adapted for locking with an inserted plug connector. The soldering plate is fixed to the peripheral wall so as to seal the pair of latch holes and the end gap. The soldering plate is located between the peripheral wall and the circuit board. The soldering plate includes at least one emboss for surface mounting onto the circuit board.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
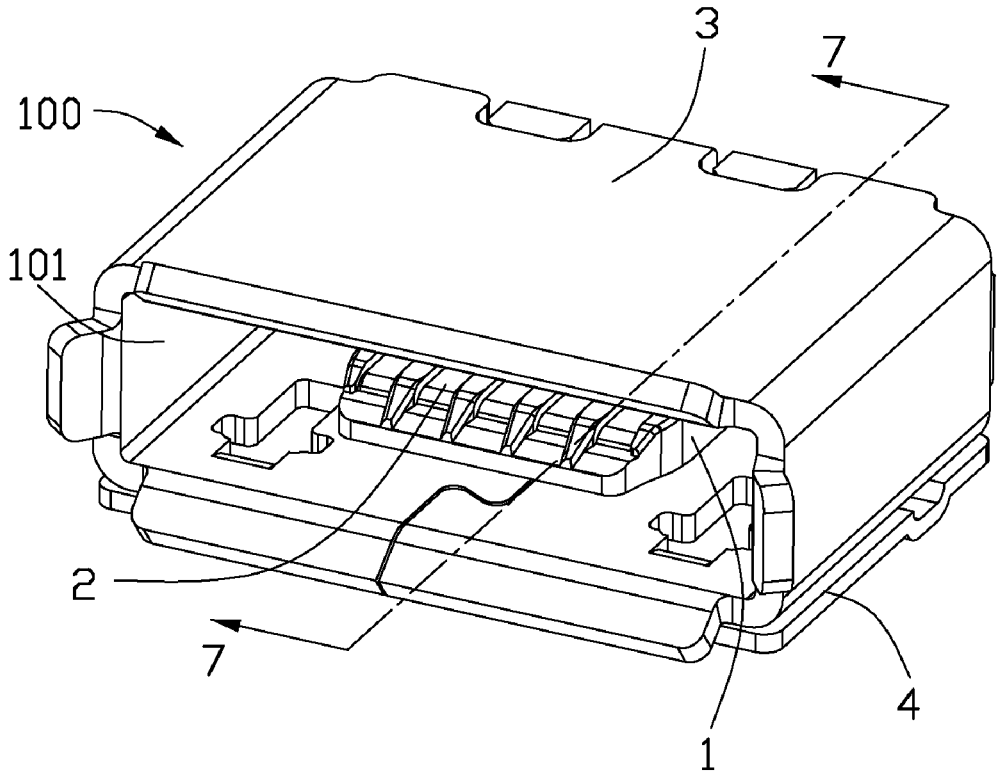
FIG. 1 is a perspective view of a waterproof connector in accordance with a first embodiment of the present invention.

Reference will be made to the drawing figures to describe the present invention in detail, wherein depicted elements are not necessarily shown to scale and wherein like or similar elements are designated by same or similar reference numeral through the several views and same or similar terminology.

FIGS. 1 to 6 illustrate a waterproof connector 100 in accordance with a first embodiment of the present invention. The waterproof connector 100 includes an insulative housing 1, a plurality of contacts 2 retained in the insulative housing 1, a metallic shell 3 enclosing the insulative housing 1, a metal soldering plate 4 attached to the metallic shell 3, and a rectangular seal ring 5 equipped to the insulative housing 1 and located between the insulative housing 1 and the metallic shell 3. The waterproof connector 100 is a Micro USB AB-type connector. A receiving space 101 is jointly formed by the metallic shell 3 and the insulative housing 1 for receiving a plug connector (not shown).

Figure 4:
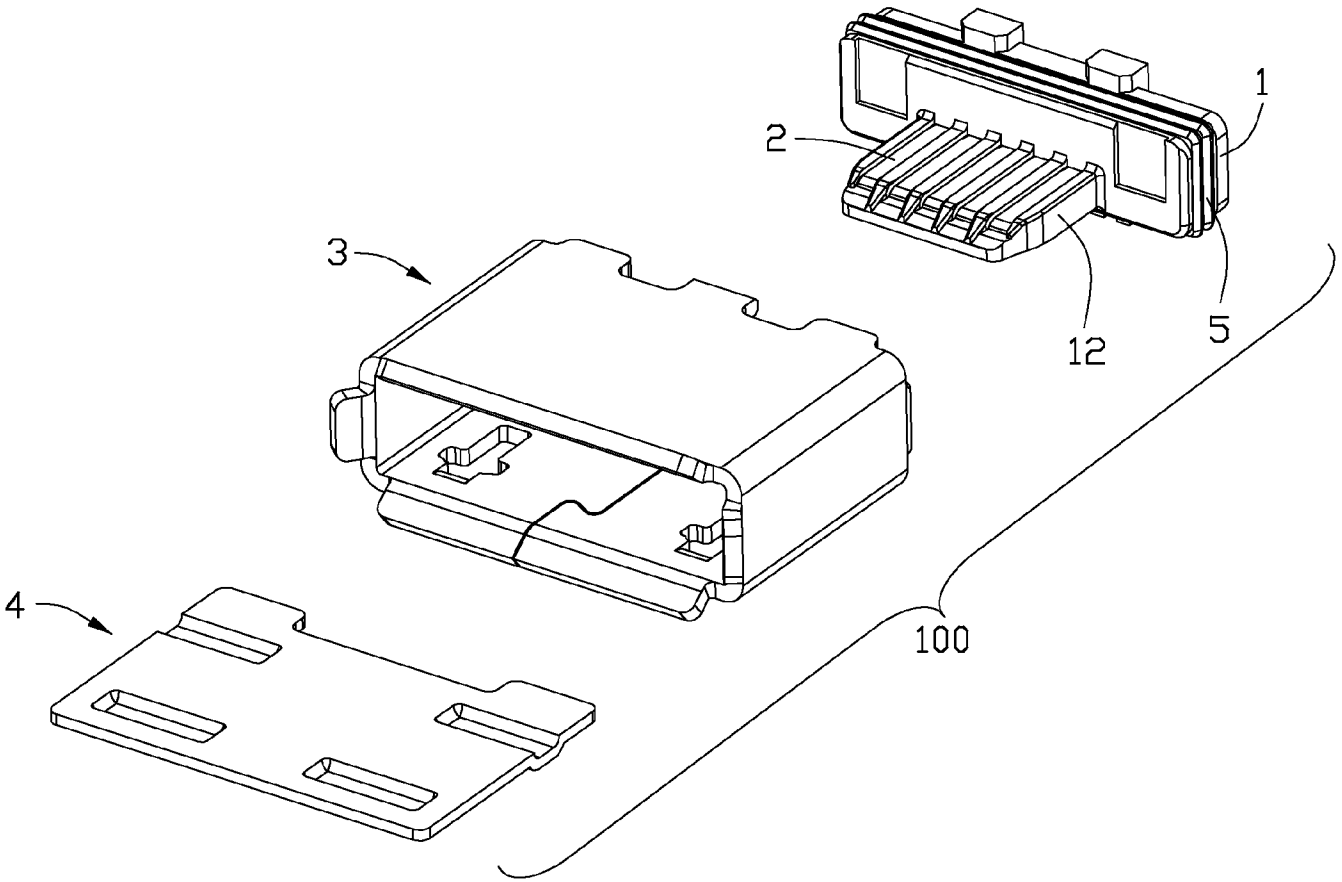
FIG. 4 is a further exploded view of the waterproof connector as shown in FIG. 3 with a metallic shell separated therefrom.
Figure 5:
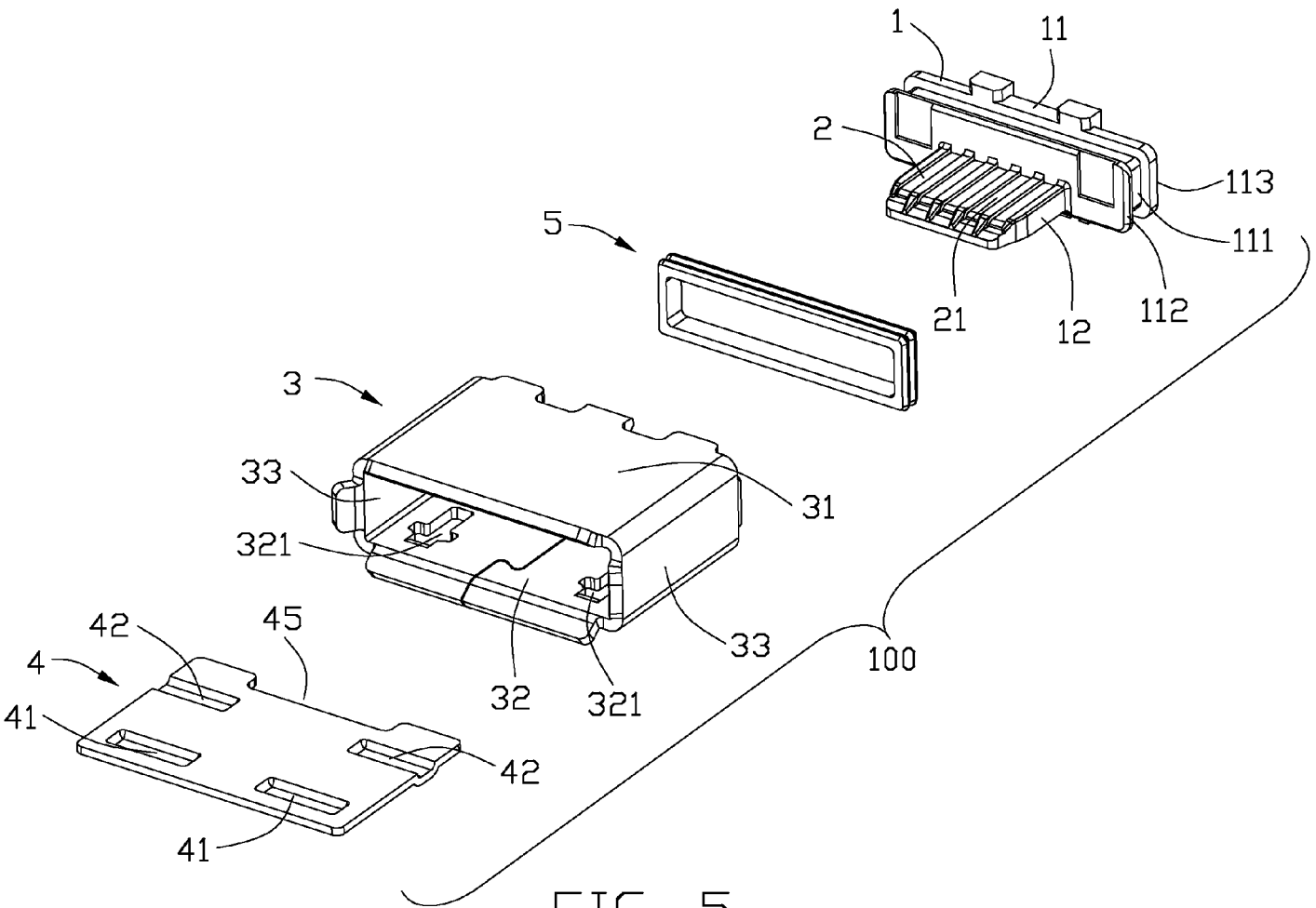
FIG. 5 is a wholly exploded view of the waterproof connector.
Figure 6:
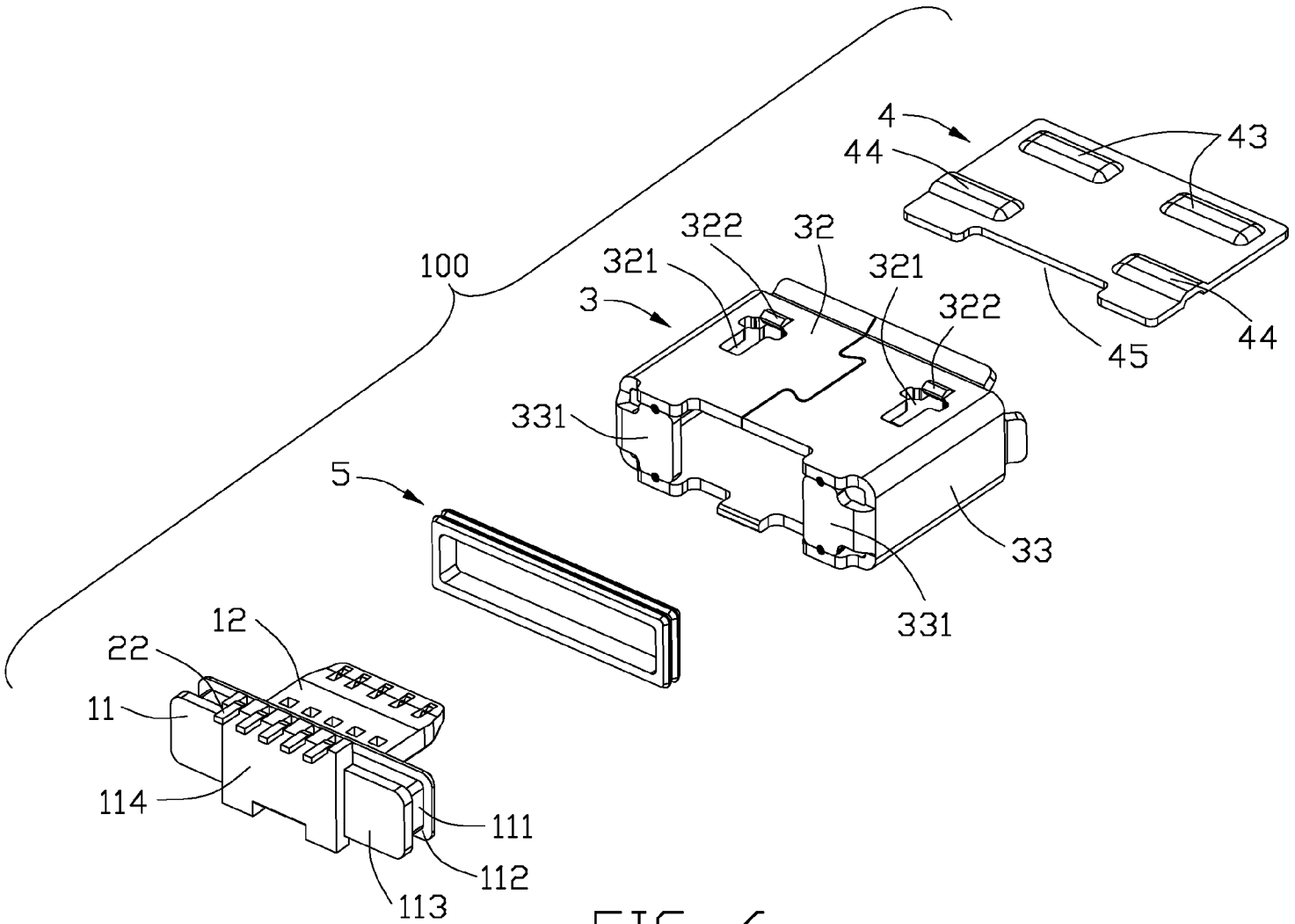
FIG. 6 is another wholly exploded view of the waterproof connector, taken from another aspect.
Figure 7:
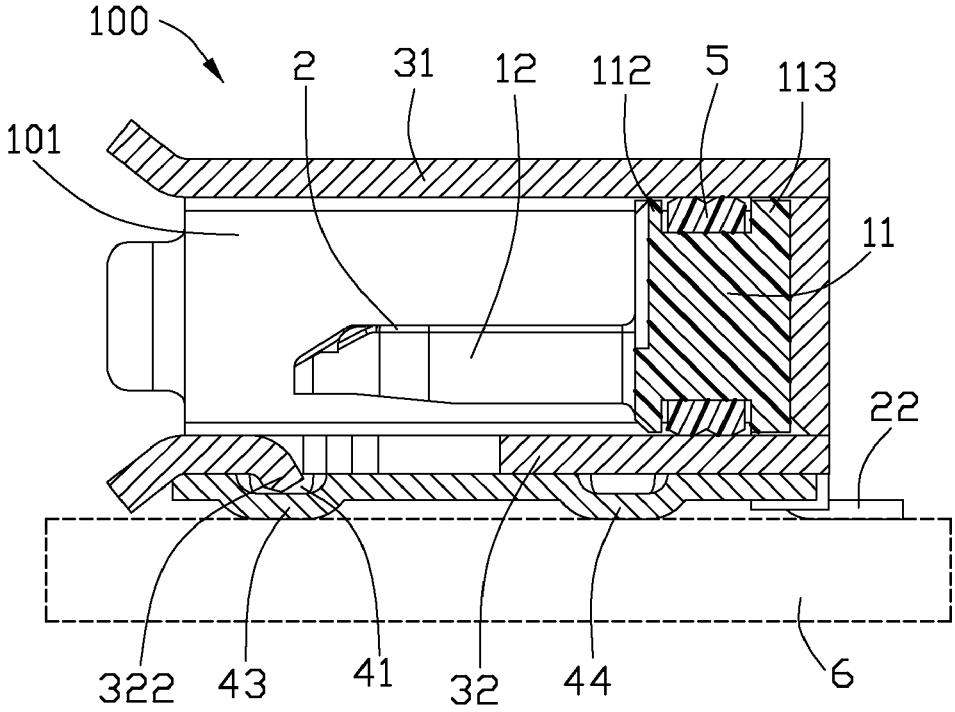
FIG. 7 is a cross-sectional view of the waterproof connector taken along line 7-7 of FIG. 1.
Figure 8:
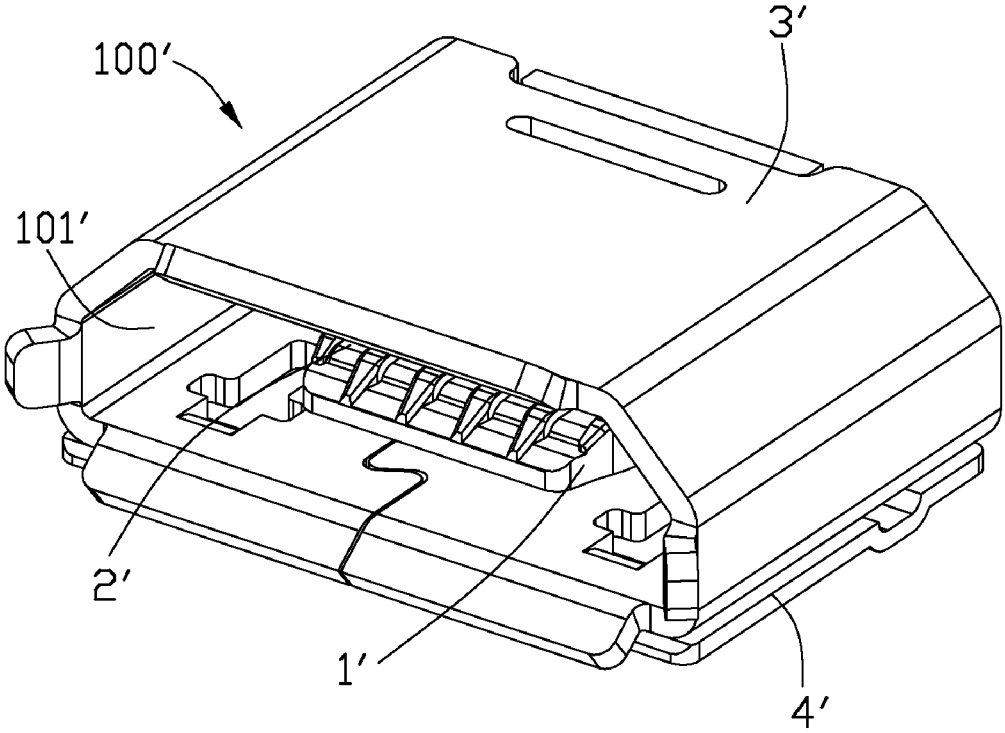
FIG. 8 is a perspective view of another waterproof connector in accordance with a second embodiment of the present invention.
Figure 9:
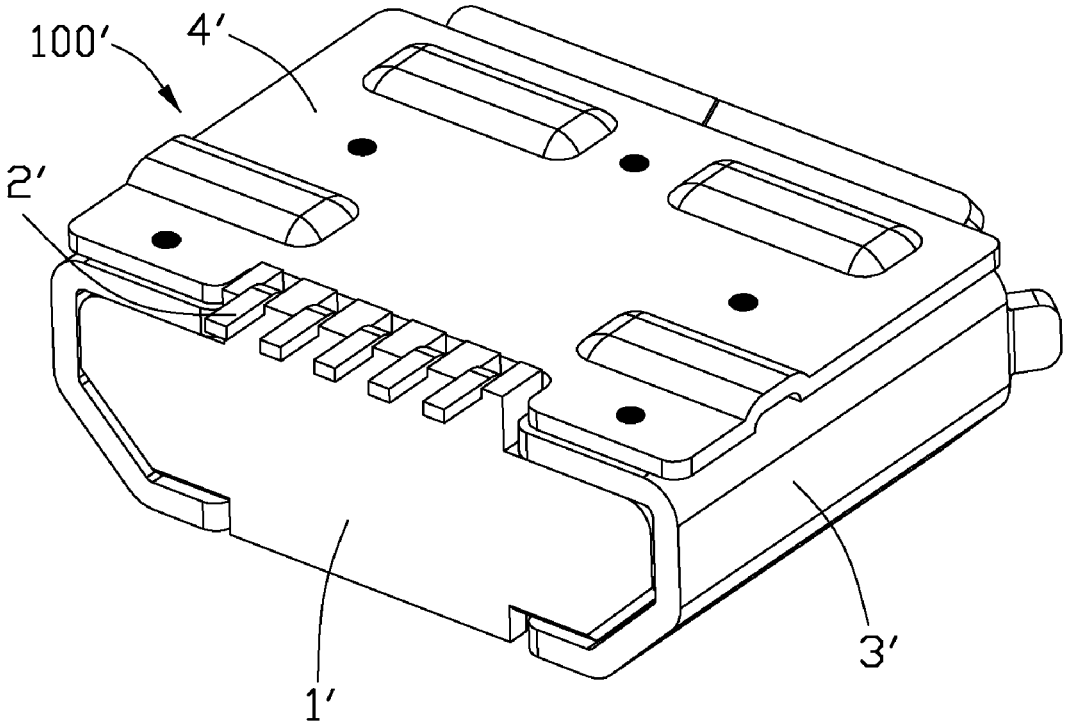
FIG. 9 is another perspective view of the waterproof connector as shown in FIG. 8.

Referring to FIGS. 5 and 6, the insulative housing 1 includes a base portion 11 and a tongue portion 12 extending forwardly from the base portion 11 and residing in the receiving space 101. The base portion 11 defines a slot 111 around its four peripheral surfaces for receiving the seal ring 5. As shown in FIGS. 4 and 7, when the seal ring 5 is equipped in the slot 111, front and rear sides of the sealing ring 5 are respectively restricted by front and rear ribs 112, 113 of the base portion 11 for preventing the seal ring 5 from falling off from the slot 111. Besides, the base portion 11 includes a rear block 114 protruding downwardly therefrom.

Referring to FIGS. 5 and 6, the contacts 2 are insert molded with the insulative housing 1 and each includes a contacting portion 21 exposed on the tongue portion 12 and a soldering tail 22 exposed to an exterior from the block 114 for mounting onto a circuit board 6 as shown in FIG. 7.

Figure 2:
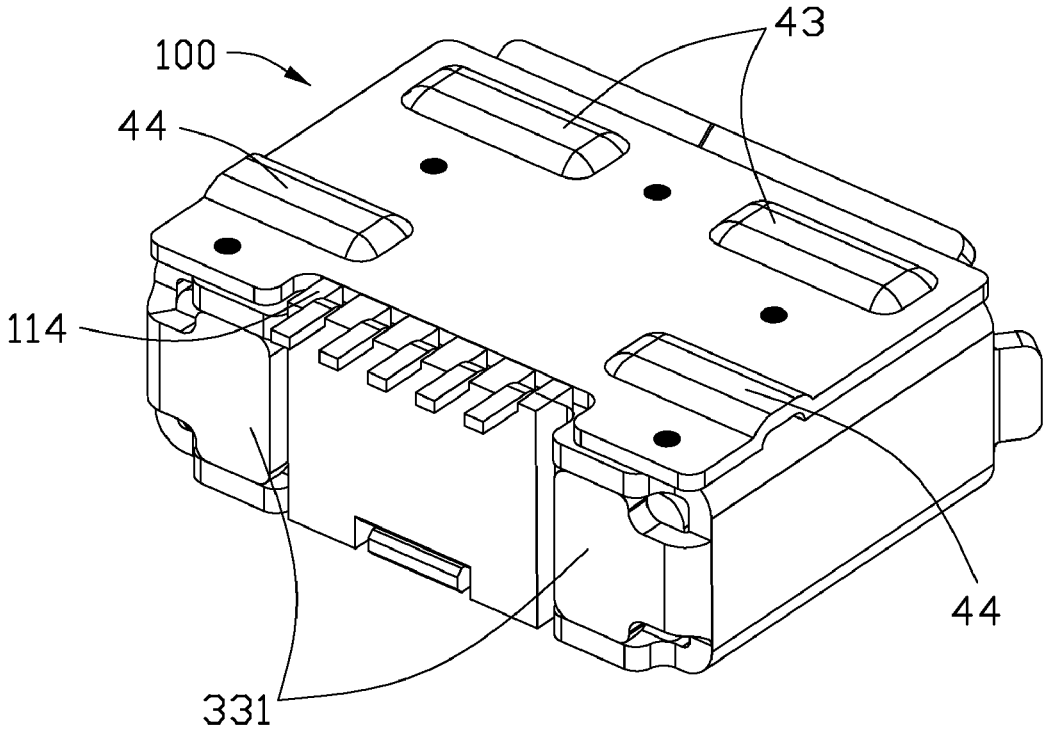
FIG. 2 is a perspective view of the waterproof connector as shown in FIG. 1, taken from another aspect.
Figure 3:
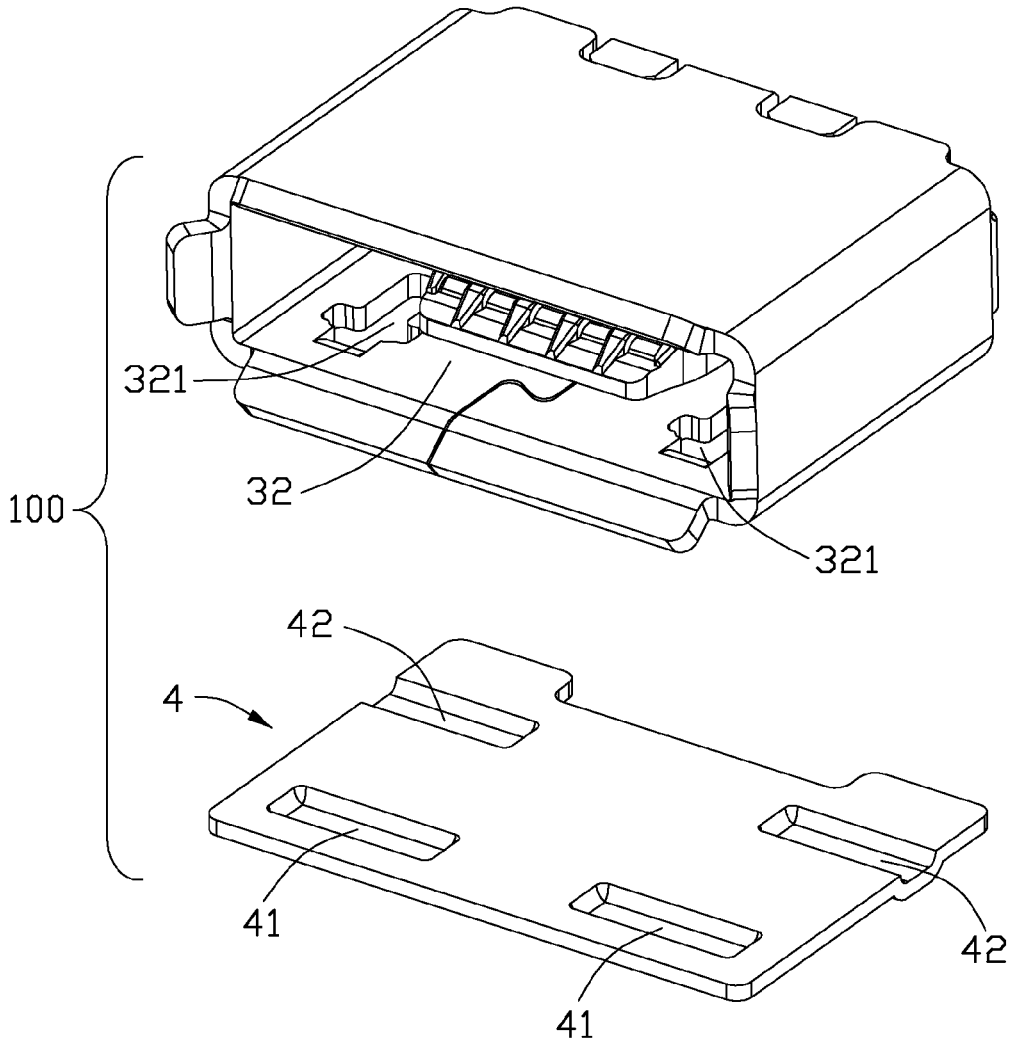
FIG. 3 is a partly exploded view of the waterproof connector as shown in FIG. 1.

Referring to FIGS. 5 and 6, the metallic shell 3 includes a top wall 31, a bottom wall 32 and a pair of side walls 33 connecting the top and the bottom walls 31, 32. The receiving space 101 is enclosed by the top wall 31, the bottom 32 and the side walls 33. Each side wall 33 includes a bending portion 331 bent sidewardly and inwardly therefrom for abutting against the base portion 11 so as to restrict the base portion 11 during assembling. As shown in FIG. 6, in order to better restrict the base portion 11 inside the metallic shell 3, top and bottom edges of each bending portion 331 can be connected (e.g. with laser welding) to corresponding top and bottom walls 31, 32, respectively. The bottom wall 32 defines a pair of latch holes 321 and a pair of tabs 322 neighboring the pair of latch holes 321. The latch holes 321 are in communication with the receiving space 101 and extend through a bottom surface of the bottom wall 32 for locking with a pair of latches of the plug connector. The tabs 322 protrude downwardly beyond the bottom surface of the bottom wall 32 for reinforcing engagement with the latches. Besides, as best shown in FIGS. 1 and 2, a sinuous end gap (not labeled) is formed at the middle of the bottom wall 32 and along material thickness of the bottom wall 32.

Referring to FIGS. 5 to 7, the soldering plate 4 is flat shaped and substantially located in a horizontal plane. The soldering plate 4 is fixed to the bottom wall 32 of the metallic shell 3 and seals the pair of latch holes 321 and the end gap so as to achieve waterproof function. According to the preferred embodiment of the present invention, the soldering plate 4 is soldered to the bottom wall 32 via laser welding or spot welding as best shown in FIG. 2. Besides, the soldering plate 4 can be soldered to the bottom wall 32 via laser welding in combination with reflow solder. In other different ways, connection of the soldering plate 4 can also be made by conductive glue or epoxy. The soldering plate 4 is stamped from the inner/top side thereof to form a pair of first recesses 41 and a pair of second recesses 42, and accordingly to form a pair of first embosses 43 corresponding to the first recesses 41 and a pair of second embosses 44 corresponding to the second recesses 42 on the outer/bottom side of the soldering plate 4. As shown in FIG. 7, the first recesses 41 are adapted for receiving the tabs 322 of the metallic shell 3. When the waterproof connector 100 is mounted on the circuit board 6, the soldering plate 4 is located between the bottom wall 32 and the circuit board 6. The first and the second embosses 43, 44 protrude towards the circuit board 6 and are adapted for surface mounting onto the circuit board 6. Besides, the soldering plate 4 defines a rear cutout 45 for receiving and positioning the block 114 of the insulative housing 1 as shown in FIG. 2. With the soldering plate 4 mounted to the bottom wall 32 of the metallic shell 3, the waterproof function can be achieved with lower height and costs.

Referring to FIGS. 8 to 11, a second embodiment of the present invention discloses another waterproof connector 100'. The waterproof connector 100' is a Micro USB B-type connector and includes an insulative housing 1', a plurality of contacts 2' retained in the insulative housing 1', a metallic shell 3' enclosing the insulative housing 1' and a metal soldering plate 4' attached to the metallic shell 3'. A receiving space 101' is jointly formed by the metallic shell 3' and the insulative housing 1' for receiving a plug connector (not shown). Since the waterproof connector 100' is similar to the waterproof connector 100 as illustrated in the first embodiment, detailed descriptions of the insulative housing 1', the contacts 2' and the soldering plate 4' in the second embodiment are omitted herein. The main differences between the waterproof connectors 100, 100' are the shape and the configurations of the metallic shells 3, 3' and corresponding shapes of the insulative housings 1, 1'.

Figure 10:
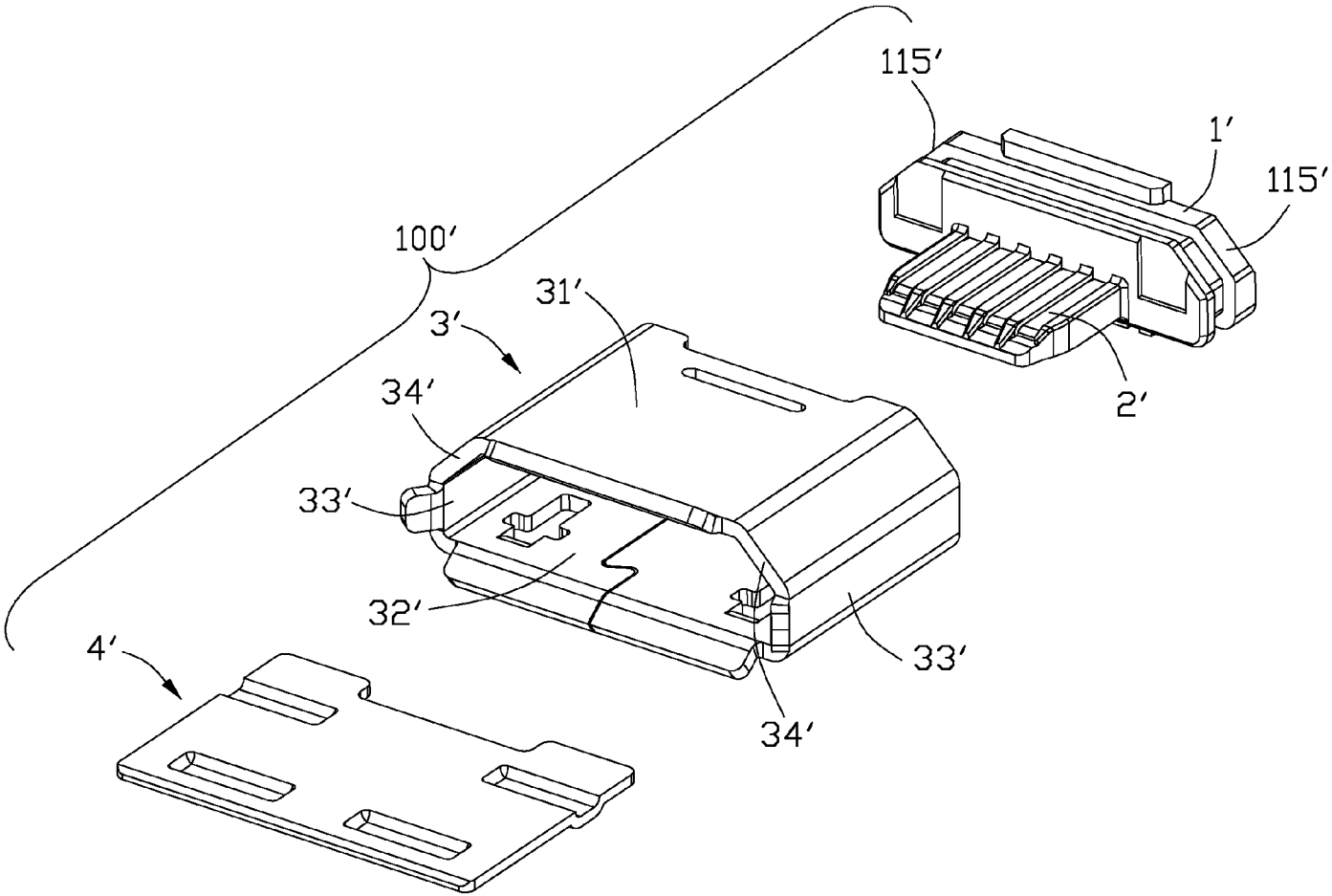
FIG. 10 is an exploded view of the waterproof connector as shown in FIG. 8.
Figure 11:
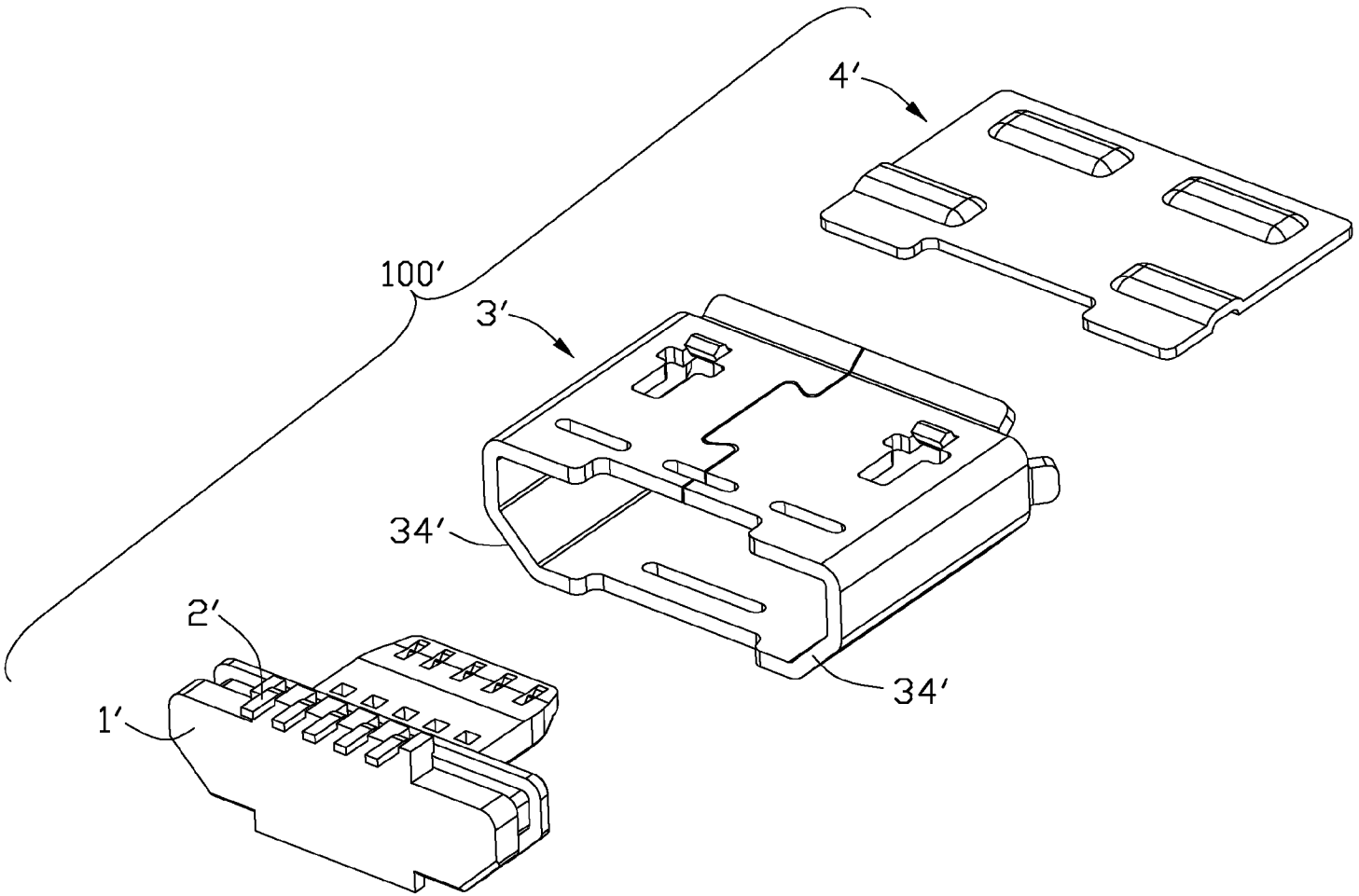
FIG. 11 is an exploded view of the waterproof connector as shown in FIG. 9.
Figure 12:
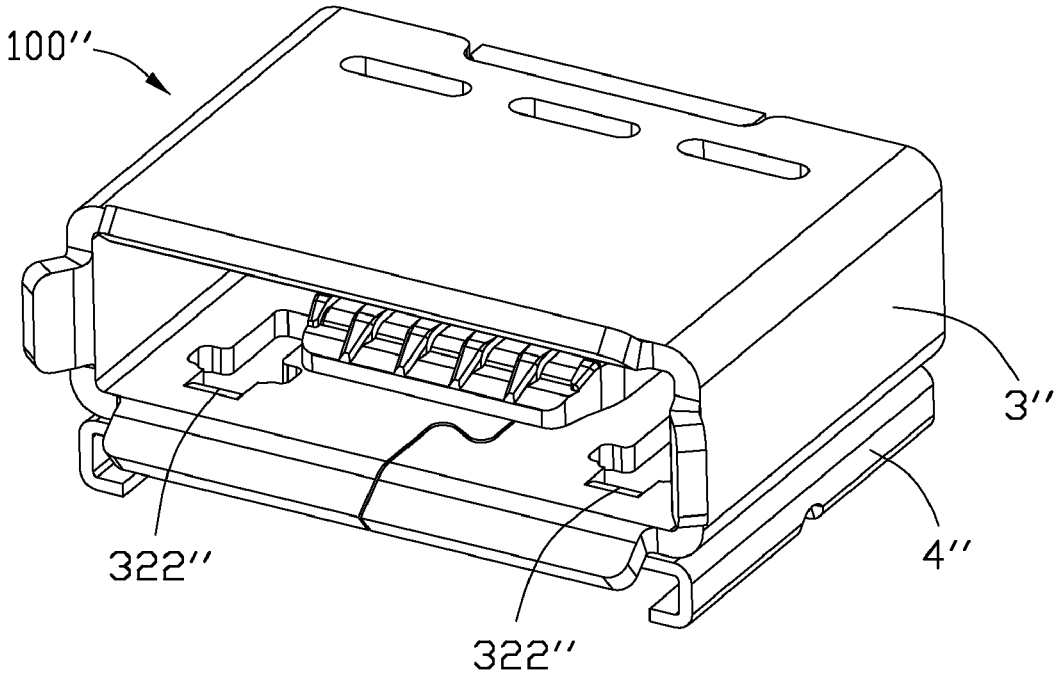
FIG. 12 is a perspective view of another waterproof connector in accordance with a third embodiment of the present invention.

Referring to FIG. 10, the metallic shell 3' includes a top wall 31', a bottom wall 32', a pair of side walls 33' connecting the top and the bottom walls 31', 32', and a pair of inclined portions 34' between each side wall 33' and the top wall 31'. The inclined portions 34' are adapted for preventing mismatching plug connectors from being inserted into the receiving space 101'. The insulative housing 1' includes a pair of inclined walls 115' configured for mating with the inclined portions 34' during assembling.

Referring to FIGS. 12 to 15, a third embodiment of the present invention discloses another waterproof connector 100" similar to the waterproof connector 100 illustrated in the first embodiment. The waterproof connector 100" includes an insulative housing 1", a plurality of contacts 2" retained in the insulative housing 1", a metallic shell 3" enclosing the insulative housing 1" and a metal soldering plate 4" attached to the metallic shell 3". The waterproof connector 100" is similar to the waterproof connector 100 as illustrated in the first embodiment except the structures of the soldering plates 4, 4".

Figure 13:
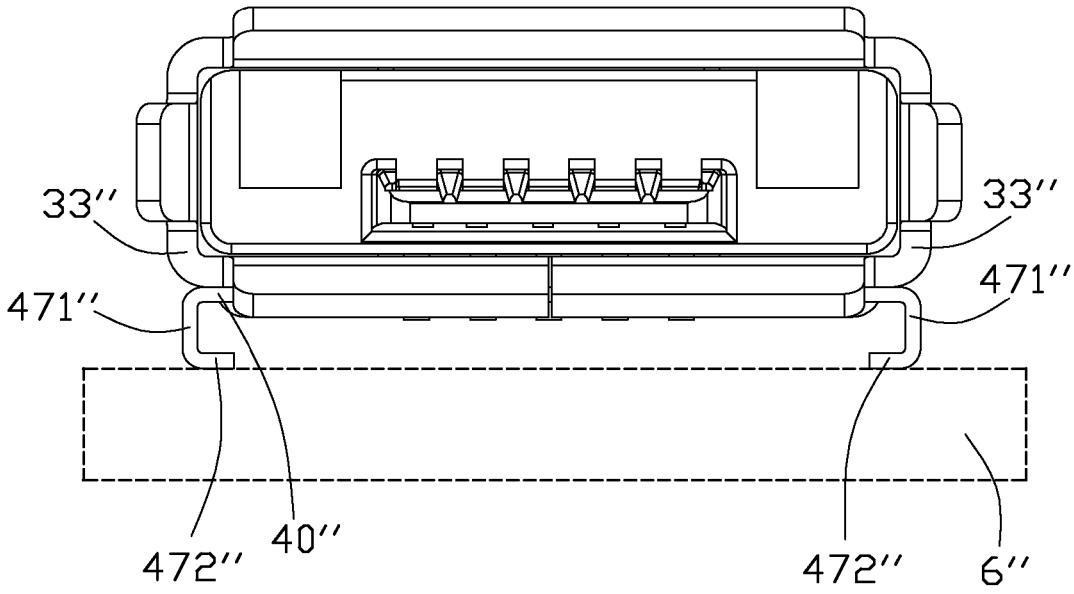
FIG. 13 is a front view of the waterproof connector as shown in FIG. 12.
Figure 14:
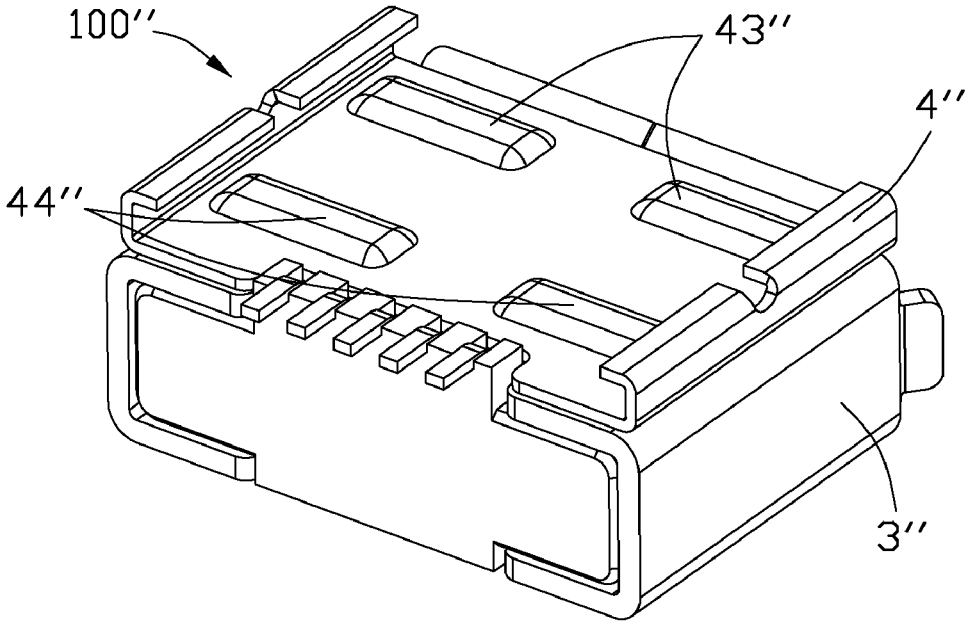
FIG. 14 is another perspective view of the waterproof connector as shown in FIG. 12, taken from another aspect.
Figure 15:
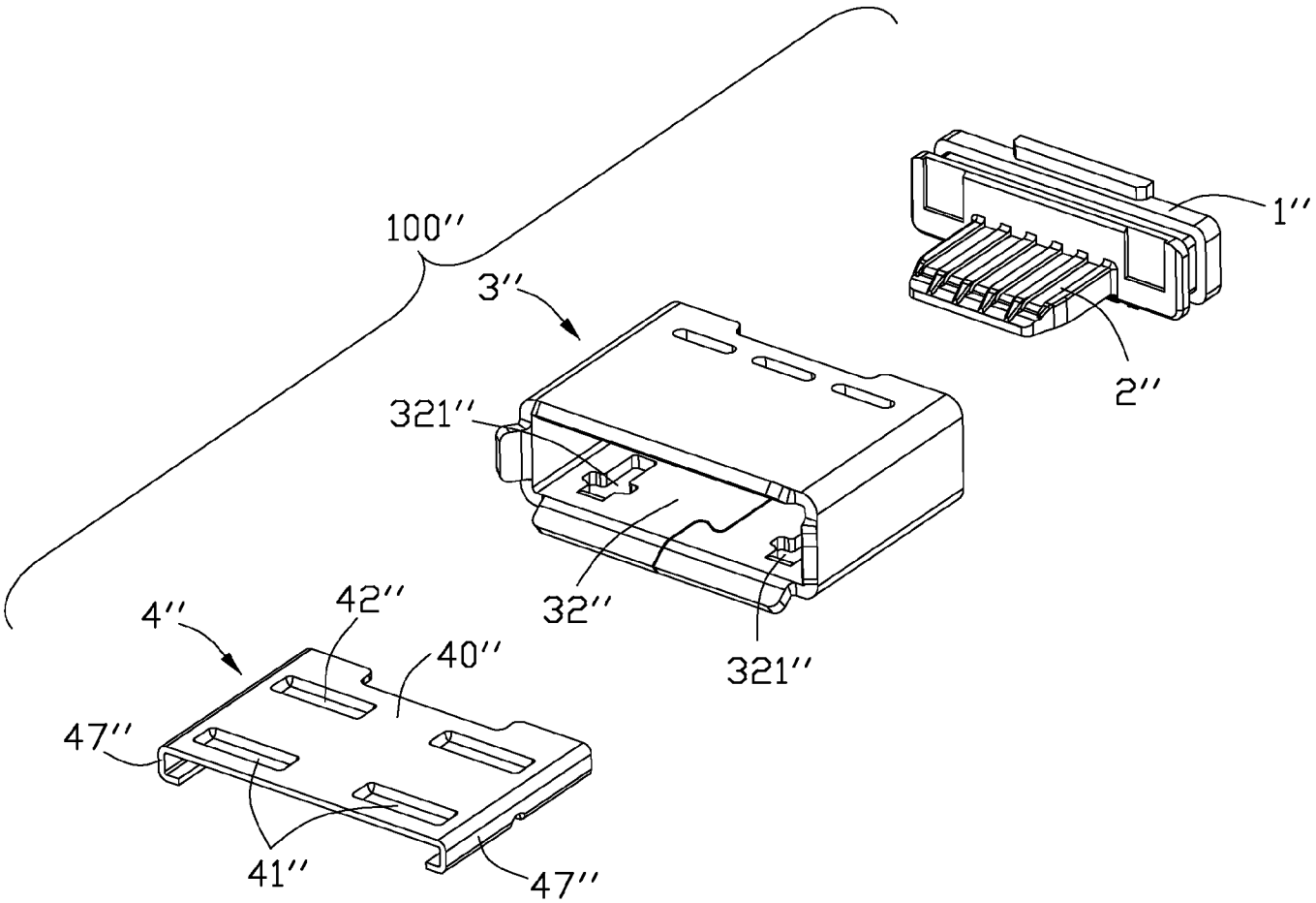
FIG. 15 is an exploded view of the waterproof connector as shown in FIG. 12.

Referring to FIGS. 13 and 15, the soldering plate 4" includes a flat plate 40" and a pair of L-shaped standoffs 47" bent downwardly from lateral edges of the flat plate 40" for straddling onto a circuit board 6" as shown in FIG. 13. The flat plate 40" is fixed to a bottom wall 32" of the metallic shell 3" and seals the pair of latch holes 321" and the end gap so as to achieve waterproof function. According to the preferred embodiment of the present invention, the flat plate 40" is soldered to the bottom wall 32" via laser weld. However, connection of the flat plate 40" can also be made by conductive glue or epoxy. The flat plate 40" is stamped from the inner/top side thereof to form a pair of first recesses 41" and a pair of second recesses 42", and accordingly to form a pair of first embosses 43" corresponding to the first recesses 41" and a pair of second embosses 44" corresponding to the second recesses 42" on the outer/bottom side of the soldering plate 4". The first recesses 41" are adapted for receiving the tabs 322" which are the same as the tabs 322 in the first embodiment.

Each standoff 47" includes a vertical portion 471" perpendicular to the flat plate 40" and a horizontal bracket 472" bent sidewardly and inwardly from the vertical portion 471". The horizontal bracket 472" is located under the flat plate 40" and is supported onto the circuit board 6". Neither of the standoffs 47" extend sidewardly beyond corresponding side walls 33" of the metallic shell 3" so that the width of the waterproof connector 100" is not enlarged. As shown in FIG. 13, when the waterproof connector 100" is mounted on the circuit board 6", the soldering plate 4" is located between the bottom wall 32" and the circuit board 6". The flat plate 40" is separated a distance from the circuit board 6" along a vertical direction by the standoffs 47". The horizontal brackets 472" are soldered to the circuit board 6". As a result, it is easy to make height variations via changing the height of the vertical portions 471".

Figure 16:
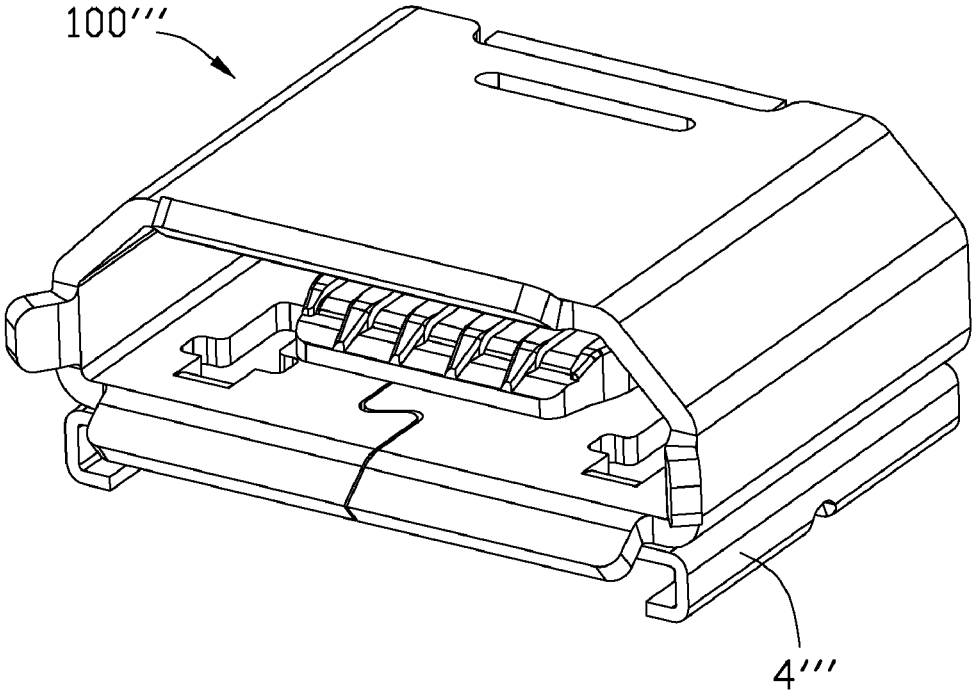
FIG. 16 is a perspective view of another waterproof connector in accordance with a fourth embodiment of the present invention.
Figure 17:
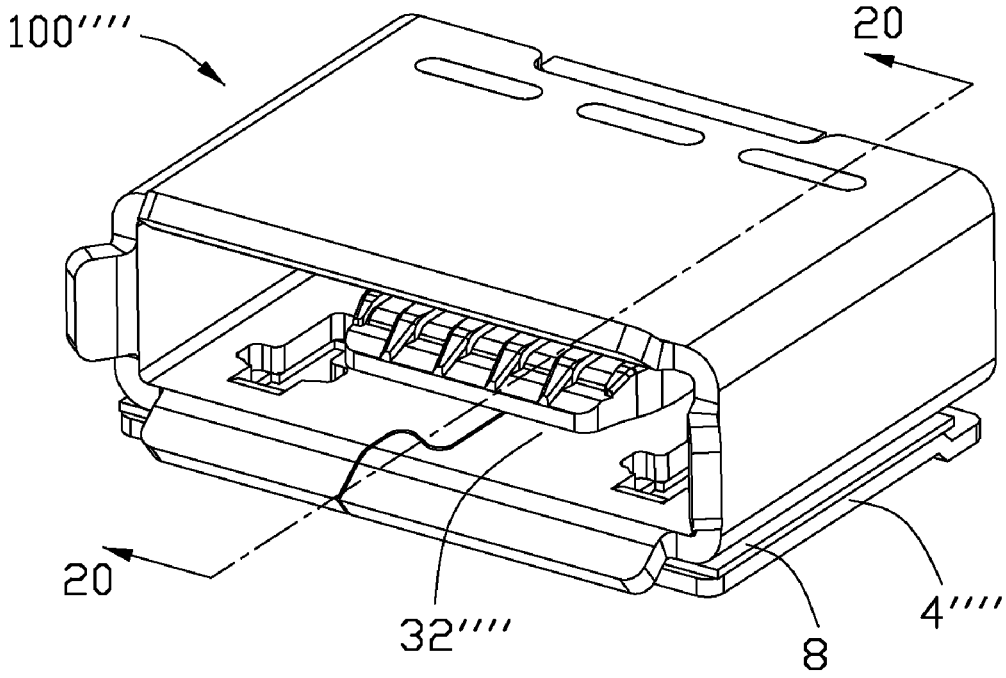
FIG. 17 is a perspective view of a waterproof connector in accordance with a fifth embodiment of the present invention.
Figure 18:
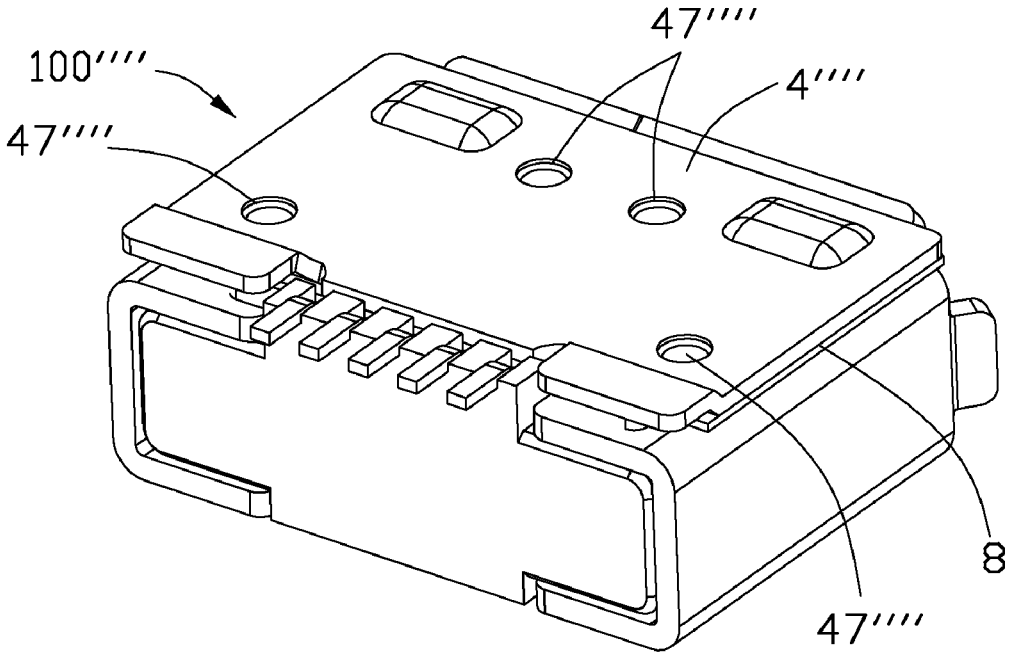
FIG. 18 is a perspective view of the waterproof connector as shown in FIG. 17, taken from another aspect.
Figure 19:
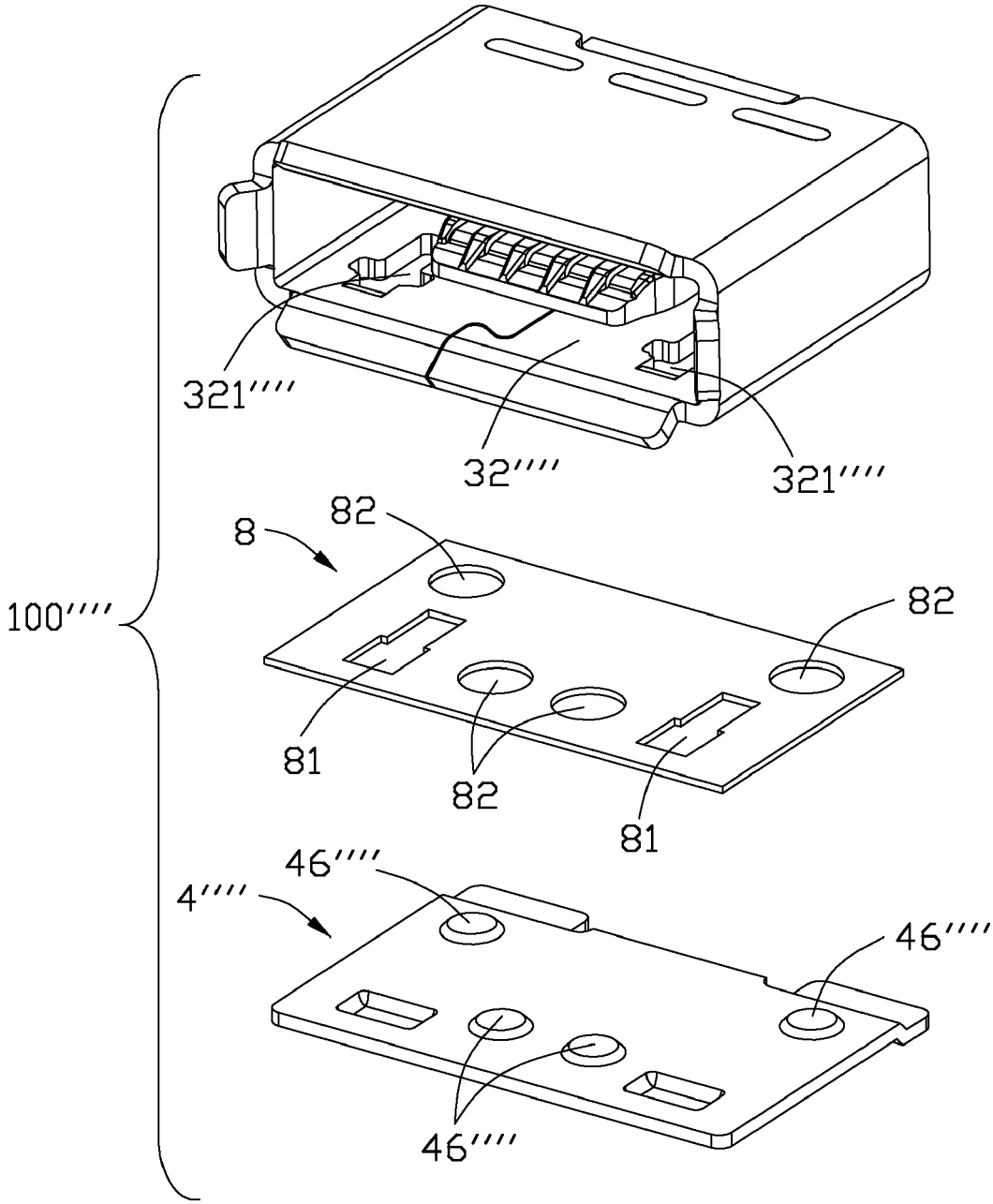
FIG. 19 is an exploded view of the waterproof connector as shown in FIG. 17.
Figure 20:
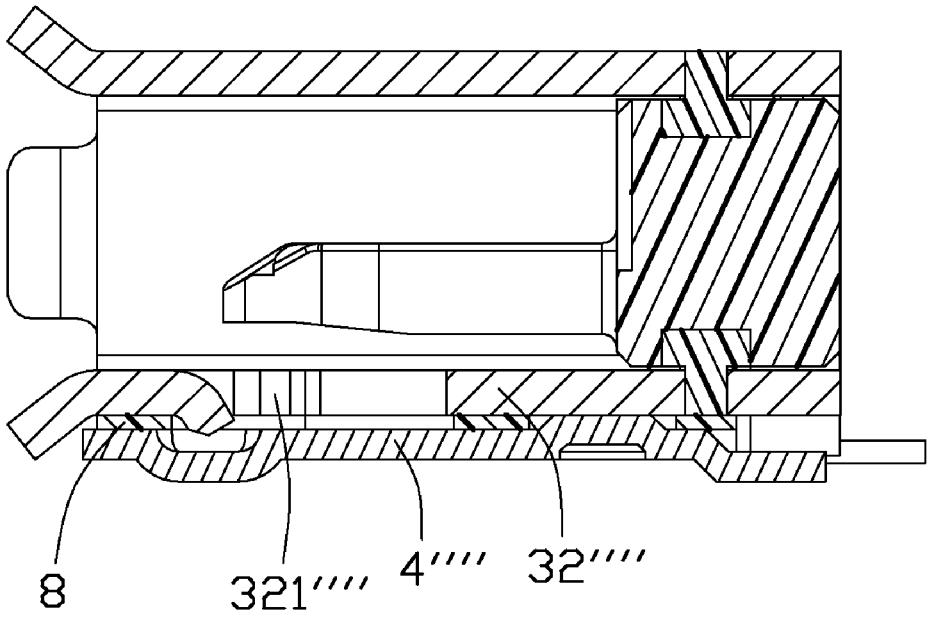
FIG. 20 is a cross-sectional view of the waterproof connector taken along line 20-20 of FIG. 17.

Referring to FIG. 16, a fourth embodiment of the present invention discloses another waterproof connector 100'" similar to the waterproof connector 100' in the second embodiment except the soldering plate 4'" which is the same as the soldering plate 4" in the third embodiment.

Referring to FIGS. 17 to 20, a fifth embodiment of the present invention discloses another waterproof connector 100"" similar to the waterproof connector 100 in the first embodiment, while the waterproof connector 100"" further includes a Mylar sheet 8 sandwiched between the bottom wall 32"" and the soldering plate 4"" for providing robust seal function. In detail, the Mylar sheet 8 defines a pair of rectangular openings 81 configured to the latch holes 321"" and a plurality of round openings 82 adjacent to the rectangular openings 81. The soldering plate 4"" is stamped to form a plurality of round protrusions 46"" on its top side, and accordingly leave a plurality of indents 47"" on its bottom side. In assembling, the round protrusions 46"" extend through the round openings 82 to be much closer to the bottom wall 32"", and the indents 47"" are adapted for easily laser welding. With the Mylar sheet 8 sandwiched between the bottom wall 32"" and the soldering plate 4"", a clearance between the bottom wall 32"" and the soldering plate 4"" along the vertical direction can be well filled in and robust waterproof function can be achieved. It is easy to be understood to those of ordinary skill in the art that the Mylar sheet 8 can be optimally located between the bottom walls 32', 32" and the soldering plates 4',4", 4'" in the second, the third and the fourth embodiments.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. A waterproof connector for mounting to a circuit board, comprising:

an insulative housing comprising a tongue portion;

a plurality of contacts fixed in the insulative housing, each contact comprising a contacting portion exposed on the tongue portion;

a metallic shell enclosing the insulative housing to jointly define a receiving space accommodating the tongue portion, the metallic shell comprising a peripheral wall defining a pair of latch holes in communication with the receiving space, the pair of latch holes being adapted for locking with an inserted plug connector; and a soldering plate fixed to the peripheral wall and covering the pair of latch holes, the soldering plate being located below the peripheral wall, the soldering plate comprising at least one embossment for surface mounting onto the circuit board.

2. The waterproof connector as claimed in claim 1, wherein the soldering plate is flat shaped and is substantially located in a horizontal plane.

3. The waterproof connector as claimed in claim 1, wherein the metallic shell comprises a top wall, a bottom wall, and a pair of side walls with the receiving space formed therebetween, the peripheral wall being the bottom wall of the metallic shell.

4. The waterproof connector as claimed in claim 3, wherein the peripheral wall comprises a pair of tabs neighboring the pair of latch holes, the tabs protruding downwardly beyond a bottom surface of the peripheral wall, the soldering plate defining a pair of recesses receiving the pair of tabs.

5. The waterproof connector as claimed in claim 3, wherein the insulative housing comprises a base portion from which the tongue portion protrudes, the base portion comprising a block protruding downwardly beyond the peripheral wall, each contact comprising a soldering tail exposed to an exterior from the block, the soldering plate defining a cutout to receive the block.

6. The waterproof connector as claimed in claim 5, further comprising a Mylar sheet sandwiched between the peripheral wall and the soldering plate.

7. The waterproof connector as claimed in claim 6, wherein the Mylar sheet defines at least one opening, the soldering plate comprising at least one protrusion and a corresponding indent at the back of the at least one protrusion, the at least one protrusion extending through the at least one opening to be much closer to the peripheral wall and the indent being adapted for laser welding.

8. The waterproof connector as claimed in claim 3, wherein the bottom wall defines an end gap which is sealed by the soldering plate.

9. The waterproof connector as claimed in claim 1, wherein the soldering plate is fixed to the peripheral wall via spot welding, or via laser welding, or via laser welding in combination with reflow solder, or by conductive glue or epoxy.

10. A waterproof connector for mounting to a circuit board, comprising:

an insulative housing comprising a tongue portion;

a plurality of contacts fixed to the insulative housing;

a metallic shell comprising a top wall, a bottom wall, and a pair of side walls together defining a receiving space, the insulative housing being enclosed by the receiving space, the bottom wall defining a pair of latch holes in communication with the receiving space for locking with an inserted plug connector; and a soldering member fixed to the bottom wall, the soldering member comprising a flat plate sealing the pair of latch holes and at least one standoff bent downwardly from the flat plate for straddling onto the circuit board, the at least one standoff separating the flat plate a distance from the circuit board.

11. The waterproof connector as claimed in claim 10, wherein there are provided two standoffs bent downwardly from lateral edges of the flat plate, the standoffs extending sidewardly up to corresponding side walls of the metallic shell.

12. The waterproof connector as claimed in claim 10, wherein the standoff comprises a vertical portion perpendicular to the flat plate and a horizontal bracket bent sidewardly and inwardly from the vertical portion, the horizontal bracket being located under the flat plate and being supported onto the circuit board.

13. The waterproof connector as claimed in claim 10, further comprising a Mylar sheet sandwiched between the bottom wall and the flat plate.

14. The waterproof connector as claimed in claim 10, wherein the bottom wall comprises a pair of tabs neighboring the pair of latch holes, the tabs protruding downwardly beyond the bottom wall, the soldering plate defining a pair of recesses receiving the pair of tabs.

15. An electrical receptacle connector assembly for use with a complementary plug connector, comprising:

an electrical connector including:

an insulative housing defining a base portion with a mating tongue extending forwardly therefrom;

a plurality of contacts disposed in the housing with contacting sections exposed upon the mating tongue;

a metallic shell enclosing the base portion and cooperating with the mating tongue to form a mating port thereof;

at least one through hole formed in a bottom wall of the metallic shell for locking a latch of the plug connector; and a metallic soldering plate covering an undersurface of the bottom wall; wherein said soldering plate defines upper and lower sections offset from each other in a vertical direction at upper and lower levels, respectively, under condition that an upper face of the upper section upwardly abuts against the undersurface of the bottom wall of the shell while a bottom face of the lower section is adapted for downwardly abutting against a printed circuit board.

16. The electrical connector assembly as claimed in claim 15, wherein the upper face of the upper section of the soldering plate is soldered to the undersurface of the bottom wall, and the bottom face of the lower section is configured to be soldered upon the printed circuit board.

17. The electrical connector assembly as claimed in claim 15, wherein a portion of the lower section is located proximate the through hole in a front-to-back direction perpendicular to the vertical direction.

18. The electrical connector assembly as claimed in claim 15, wherein the portion of the lower section defines an upward recess to receive therein a downward tab which is used for guidably holding the latch of the plug connector.

19. The electrical connector assembly as claimed in claim 18, wherein said recess is not laterally communicative to an exterior.

20. The electrical connector assembly as claimed in claim 15, wherein the bottom surface of the lower section is coplanar with tail sections of the contacts exposed behind the housing.

* * * * *